United States Patent [19]

Wilfong et al.

[11] Patent Number: 4,802,566

[45] Date of Patent: Feb. 7, 1989

[54] COIN SLIDE GUARD

[75] Inventors: Evan C. Wilfong, Philadelphia; Harvey S. Gitlin, Ambler, both of Pa.

[73] Assignee: Equipment Systems & Devices, Inc., Ambler, Pa.

[21] Appl. No.: 82,377

[22] Filed: Aug. 6, 1987

[51] Int. Cl.[4] ..... G07F 1/00

[52] U.S. Cl. ..... 194/350; 194/343

[58] Field of Search ..... 194/202, 228, 234, 235, 194/236, 237, 238, 243, 249, 291, 310, 343, 344, 350, 351, 353

[56] References Cited

U.S. PATENT DOCUMENTS

| | | | |
|---|---|---|---|
| 2,044,107 | 6/1936 | Shinn | 194/291 |
| 3,111,213 | 11/1963 | Hall | 194/343 |
| 3,602,352 | 8/1971 | Robinson | 194/238 |
| 4,350,240 | 9/1982 | Gitlin et al. | 194/234 |
| 4,515,262 | 5/1985 | Wilfong et al. | 194/343 |

FOREIGN PATENT DOCUMENTS

| | | | |
|---|---|---|---|
| 0076902 | 12/1953 | Denmark | 194/350 |

*Primary Examiner*—Joseph J. Rolla
*Assistant Examiner*—Edward S. Ammeen
*Attorney, Agent, or Firm*—Steele, Gould & Fried

[57] ABSTRACT

A guard for the mounting flange of a vertical type coin slide includes a hardened steel face and a rearwardly extending, integral, peripheral flange. The face of the guard includes a shaped opening to receive the slide of the coin slide therethrough. The opening includes a plurality of transversely spaced slots with a respective plurality of protective fingers therebetween. The protective fingers overfit and protect the softer metal dividers of the mounting flange to prevent breakage. A plurality of slotless mounting bolts secure the guard to the coin slide mounting flange in a manner wherein all exposed bolt parts are protected from tampering.

6 Claims, 1 Drawing Sheet

COIN SLIDE GUARD

BACKGROUND OF THE INVENTION

1. Field of the Invention

The present invention relates generally to coin mechanisms useful in the vending machine industry, and more particularly, is directed to a coin slide guard suitable for use to protect mounting flanges of coin slides of the type recently designed and developed to accept a plurality of coins in vertical orientation.

2. Discussion of the Prior Art

Coin slides have long been utilized in the vending machine industry to initiate numerous types of coin operated mechanisms. The prior art coin slides have increasingly been improved to include better means to check the coins for denomination and authenticity prior to vending and to store the coins received by the coin slide in a locked container for later collection by the owner or manager of the vending operation. More recently, as prices have begun to vary with increasing rapidity, and as vending operations have become more costly, coins slides capable of accepting increased numbers of coins have been developed. Most recent improvements in the coin slide industry have been directed toward accepting coins in vertical orientation in a manner to conserve space and to provide a device that is both compact and reliable.

In the coin slides disclosed in U.S. Pat. Nos. 4,350,240 and 4,515,262, which patents are owned by the assignee of the present application, vertical type coin slides are disclosed which are characterized by a body having an integral mounting flange for securing the coin slide to a vertical panel of a vending machine in a usual manner. A slide including a forward handle is movable longitudinally relative to the body for vending machine operational purposes upon the insertion of the correct number and correct denomination of coins. The coins are received in vertical orientation in suitably dimensioned openings in the slide and extend upwardly therefrom prior to vending. Upon insertion of the correct number and denomination of coins, the slide can then be pushed inwardly past the mounting flange for internal checking and coin receiving prior to initiation of the vending operation. Accordingly, the flange must be provided with a plurality of properly sized slots in alignment with the coin receiving openings in the slide to allow the coins to pass through the flange during the initiation of the vending operation. These slots are defined by vertically depending teeth, which teeth are transversely spaced across the mounting flange.

It is currently the usual practice to fabricate the coin slide bodies and flanges using the die cast process whereby the precise configurations required for proper operation can be accurately formed by utilizing this technique. While the use of die cast metal is advantageous for its ability to be formed to exact and well-defined configurations, such use is limited in certain applications because it is also a relatively weak material. The vertical projections or teeth formed in the flange to define the required coin passage slots are narrow in dimensions and represent the weakest part of the exposed portions of the coin slide. These teeth or projections are known to be subject to attack by readily available tools, such as a simple screw driver. This enables a determined thief to provide an enlarged opening through which the internal mechanism can be reached. Despite the advantage and improvements offered by the newer types of vertical coin slides in better coin checking and in ease in price changing, the need remains to additionally protect the relatively weaker portions of the die cast flange.

SUMMARY OF THE INVENTION

The present invention relates generally to improved coin slides, and more particularly, is directed to a hardened steel guard or protector suitable for use with existing coin slides of the type which are designed to accept four, five, six or eight coins in vertical orientation.

The coin slide guard of the presnet invention comprises a unitary protective member which is compatible for use with existing vertical coin slides and which is partiuclarly adapted to be secured over the exposed portions of the coin slide flange in a manner to provide increased resistance to attack by providing an inexpensive, aesthetically pleasing and extremely sturdy protective cover. The protective cover includes mounting holes which register over and are aligned with the existing openings which are normally provided in the coin slide mounting flange for securing the coin slide to the vending machine. Bolts having rounded, slotless heads exteriorly insert through the protective cover mounting holes and the flange openings and are secured by rearwardly positioned nuts in a manner to completely protect the bolts and nuts from tampering. A plurality of precisely configured slots are formed in the guard of dimensions and positioned to exactly correspond with the dimensions and positions of the slots provided in the flange for passage of the vertically oriented coins. The coins will therefore also pass through the guard vertical slots when the coin slide is rearwardly moved. The coin receiving slots in the guard define vertically depending teeth therebetween and these teeth closely overfit and protect the similarly configured teeth provided in the coin slide mounting flange. Accordingly, the softer mounting flange teeth cannot be reached by a screw driver and will therefore be protected from attack.

In the preferred embodiment, the coin slide guard of the present invention is fabricated of 1085 cold rolled steel sheet of 0.080 inches in thickness. All corners are properly rounded in known manner to provide a finished aesthetically pleasing appearance. To further enhance the appearance of the coin slide guard, preferably at least the exterior surface can be treated with a copper-nickel chrome plated finish which finish can then be polished to a high luster. The guard not only effectively protects the depending mounting flange teeth from damage and breakage, it also overfits and protects some of the flange mounting bolts in a manner to prevent unauthorized removal of the entire coin slide.

It is therefore an object of the present invention to provide an improved coin slide guard of the type set forth.

It is another object of the present invention to provide a novel coin slide guard suitable for use with vertical coin slides which comprises a heavy cold rolled steel protective construction over and about the exposed portions of a coin slide mounting flange.

It is another object of the present invention to provide a novel coin slide guard comprising a unitary body of configuration to overfit a coin slide mounting flange, the guard being fabricated of hardened steel construction, the guide being provided with configured areas conforming to the configured areas of the mounting flange whereby all exposed areas of the mounting flange will be protected by the hardened steel components of the coin slide guard.

It is another object of the present invention to provide a novel coin slide guard for overfitting the mounting flange of a vertical coin slide, the guard being fabricated of hardened cold rolled steel, the guard being provided with an opening to receive the slide therethrough to permit unobstructed reciprocal operation of the slide, the guard further being provided with a plurality of vertical, transversely spaced slots in alignment with the coins in the coin slide to provide protective hardened steel slots in position to receive the coins therethrough during the vending operation.

It is another object of the present invention to provide a novel coin slide guard that is simple in construction, virtually tamper-proof when installed and trouble-free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 2:
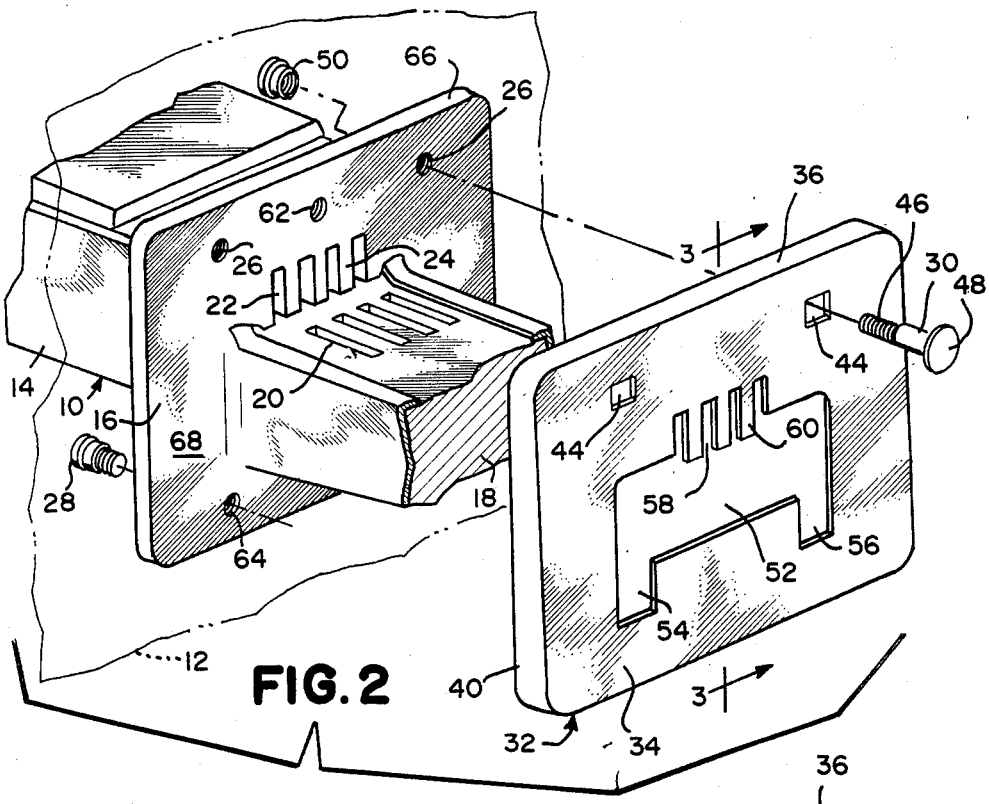
FIG. 2 is an exploded, perspective view of the coin slide guard and coin slide of FIG. 1.

Although specific terms are used in the following description for the sake of clarity, these terms are intended to refer only to the particular structure of the invention selected for illustration in the drawings, and are not intended define or limit the scope of the invention.

Figure 1:
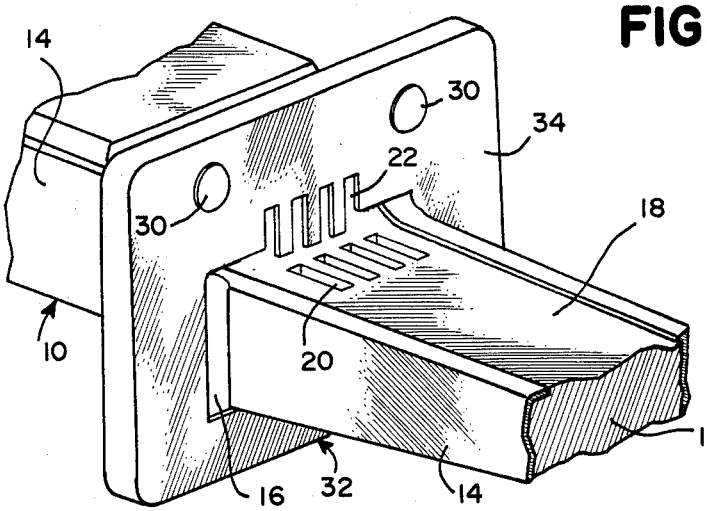
FIG. 1 is a perspective view showing the coin slide guard of the present invention installed over the mounting flange of a coin slide.

Referring now to the drawings, there is shown in FIGS. 1 and 2 a conventional vertical type coin slide 10, which coin slide may be similar to that illustrated to said U.S. Pat. No. 4,350,240. The coin slide is secured in conventional manner in a vertical panel 12 of a suitable coin operated vending machine, for example, a washing machine or a drying machine of the type generally installed in coin operated laundries, apartment buildings and the like.

The coin slide 10 comprises generally a body 14 which incorporates an integral mounting flange 16 in known manner. A slide 18 is horizontally reciprocal relative to the body 14 in usual manner upon insertion of the correct coins to initiate the vending cycle. The slide includes a plurality of coin receiving slots 20 to receive, initially size and return a plurality of coins (not shown) in vertical orientation for payment of the predetermined vending price. While a plurality of four coin receiving slots 20 are illustrated, it will be appreciated that at the present time, four coin slides, five coin slides, six coin slides and eight coin slides are currently available. Also, in the future, additional needs may dictate that other numbers of coins should be accommodated. The basic concept of the present invention will be the same no matter how many coins receiving slots are provided and accordingly, the invention will be described for use with the four coin receiving slot 20 as illustrated. However, more coin receiving slots or fewer coin receiving slots can be provided in conventional manner and the protective cover of the present invention will still function in the same manner as herein illustrated and described. Thus, the invention is not limited to any particular number of coin receiving slots and should be therefore broadly interpreted as relating to all coins slides designed to accommodate vertically oriented coins.

As best seen in FIG. 2, the mounting flange 16 is provided with a plurality of vertical, transversely spaced openings 22 which openings are conventional in size and configuration to receive therethrough and initially monitor the diameter of coins (not shown) that will have been previously vertically positioned within the coin slide coin receiving slots 20. Suffice it to say that one such vertical opening 22 is provided in longitudinal alignment with each coin receiving slot 20 provided in the coin slide 18. The plurality of vertical openings 22 define therebetween a plurality of relatively thin, depending teeth or dividers 24 and it is these teeth that are subject to breakage when attacked by a sturdy type of prying instrument, for example, a screw driver or similar implement. The mounting flange 16 comprises a plurality of mounting openings 26, usually corner positioned and four in number, which may be threaded to conventionally receive a rearwardly positioned mounting bolt. In the present situation, only a pair of transversely spaced, lower mounting bolts 28 are conventionally employed for rearward installation and protection. As hereinafter more fully set forth, a pair of upper, front mounting bolts 30 are utilized to secure the coin slide guard of the present invention.

Figure 3:
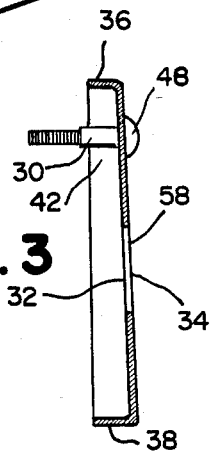
FIG. 3 is a cross sectional view taken along line 3—3 on FIG. 2, looking in the direction of the arrows.

As illustrated in FIGS. 1, 2 and 3, the coin slide guard 32 of the present invention is configured to overfit and protect the mounting flange 16 and comprises generally a planar front face 34 of rectangular construction of configuration to correspond to and overfit the outer periphery of the slide mounting flange 16. The coin slide guard 32 is preferably fabricated of hard steel material of suitable gauge to resist bending or breaking, for example, 1085 cold rolled steel 0.080 inches in thickness. If desired, the exposed surfaces of the coin slide guard 32 may be plated with a copper-nickel chrome plating to provide a high luster upon proper buffing.

The coin slide guard 32 comprises an outer periphery of shallow, rearwardly extending, top and bottom walls 36, 38 and interconnected left and right walls 40, 42. The guard 32 is particularly configured and dimensioned to overfit and protect the entire mounting flange 16 of the coin slide 10 and especially the teeth or dividers 24. As best seen in FIG. 2, the coin slide guard front face or body 34 is provided with a pair of upper securing openings 44, which securing openings register over and align with the coin slide mounting openings 26. A pair of upper, threaded, mounting bolts 30 insert through the aligned pairs of openings 44, 26 from front to rear as shown. Each mounting bolt 30 comprises a threaded shank 46 and a slotless, rounded head 48. The rounded head 48 can be chrome finished to correspond with the chrome plating over the coin slide guard 32 to provide a finished appearance if desired. The slotless configuration of the rounded bolt head 48 provides a smooth outward finish which will discourage attack by most easily available tools and instruments to prevent unwanted removal of the guard 32. A pair of rearwardly positioned, threaded nuts 50 rearwardly threadedly engage the threaded shanks 46 of the upper mounting bolts 30 to simultaneously secure the upper portion of the mounting flange 16 within the vertical panel 12 of the vending machine (not shown) with the coin slide guard 32 forwardly secured over the mounting flange 16 in a manner to completely cover and protect the mounting flange.

The coin slide guard 32 is provided with a configured opening 52 having integral, depending slots 54, 56 of size and configuration to slidingly receive the slide 18 of the coin slide 10 therethrough. The opening 52 is upwardly provided with a plurality of transversely spaced slots 58 of size, number and configuration to exactly conform to the size, number and configuration of the vertical openings 22 which are provided in the mounting flange 16. The slots 58 define therebetween a plurality of protective fingers 60. The protective fingers 60 register over and precisely cover the entire front faces of the downwardly projecting teeth or dividers 24 of the coin slide mounting flange 16. Should someone attempt to attack the coin slide 10 at the spaced teeth or dividers 24 thereof, the would-be thief would have to first bend, twist or otherwise deform the protective fingers 60. Inasmuch as these fingers 60 are formed of the same cold rolled steel construction as the coin slide guard 32 itself, these protective fingers are exceedingly sturdy and will resist deformation, breaking, bending, twisting or other attack. Accordingly, an effective barrier to breaking the mounting flange teeth 24 has been provided.

Further, it is the usual practice to provide additional, lower mounting holes 64 which can be threaded to threadedly receive the rearwardly positioned lower mounting bolts 28. As shown in FIG. 2, the lower mounting bolts 28 normally mount rearwardly of the mounting flange 16 so as not to be subject to tampering from the front of the vending machine (not shown). Further, an upper, central, threaded, mounting opening 62 is usually provided intermediate the upper mounting openings 26 to rearwardly receive therein an additional, conventional, mounting rod or screw (not shown) for securing the mounting flange in position in the vending machine. Here again, this opening was previously exposed to attack from the front and therefore presented a weakness in the security of the installation. In the present invention, the coin slide guard 32 is particularly designed to not provide any type of cooperating opening or other access in registry over the central opening 62 to thereby completely cover and protect the existing mounting screw or rod (not shown). As best seen in FIG. 1, when the coin slide guard 32 of the present invention is properly installed, the threaded opening 62 will be entirely covered and protected. Additionally, as shown in FIG. 1, the lower mounting openings 64 will also be entirely covered and protected by the planar front face 34 of the coin slide guard 32.

In use, a conventional coin slide 10 can be mounted in the vertical panel 12 of a vending machine in the usual manner by initially employing a pair of lower mounting bolts 28 which threadedly engage the threaded lower mounting openings 64 which are conventionally provided in the coin slide mounting flange 16. The upper, central mounting rod or screw (not shown) is similarly rearwardly engaged within the threaded upper central opening 62 to initially secure the coin slide with all fasteners 28 rearwardly positioned and protected. Then, the coin slide guard 32 of the present invention can be introduced over the exterior portions of the slide 18 and the body 14 of the coin slide 10 and can be rearwardly urged until the guard 32 completely covers the mounting flange 16. When properly positioned, the guard top and bottom walls 36, 38 and left and right walls 40, 42 will completely cover and protect the outer periphery 66 of the mounting flange 16. The guard front face 34 will overfit and protect the front face 68 of the mounting flange 16 to thereby provide a hardened steel jacket completely over and about the die cast mounting flange 16. When the coin slide guard 32 is in correct position, the protective fingers 60 of the guard 32 will lie directly over and in front of the depending teeth or dividers 24 of the mounting flange. When the coin slide guard 32 is properly positioned, the upper securing openings 44 will be in registry over the upper mounting openings 26 provided in the mounting flange 16 and the upper mounting bolts 30 can be rearwardly inserted through the aligned upper openings 44, 26 until the domed slotless heads 48 contact the front face 34 of the coin slide guard 32. Conventional threaded nuts 50 can then be rearwardly engaged over the threaded shanks 46 of the mounting bolts 30 to secure the parts in position in a manner whereby everything is completely rearwardly protected and not easily subject to attack from the front.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A coin slide guard for protecting a coin slide mounting flange having an outer periphery and a predetermined thickness and of the type having a plurality of transversely spaced slots with dividers respectively therebetween and a plurality of mounting openings through the mounting flange comprising:

a unitary hardened steel face forwardly overlying the mounting flange, said face including a face outer periphery which terminates in a hollow, peripheral flange having top and bottom walls and joining left and right walls following said outer periphery of said mounting flange, said guard flange walls extending in depth sufficiently to cover the entire peripheral thickness of the coin slide mounting flange, the face being provided with an opening to receive a portion of a coin slide therethrough, the opening being upwardly shaped to provide a plurality of transversely spaced slots, the slots being defined by respective protective fingers therebetween, the face being provided with a plurality of securing openings, at least some of the securing openings in the guard face registering over and aligning with a mounting opening in the mounting flange, the protective fingers of the guard overlying and protecting the dividers of the mounting flange when the guard securing openings are in registry over the flange mounting openings; and at lesat one fastener positioned through an aligned pair of mounting opening and securing opening to secure the guard to the coin slide mounting flange.

2. The coin slide guard of claim 1 wherein the fastener comprises a shank, at least a portion of the shank being threaded, the shank terminating at one end in an enlarged unslotted head.

3. The coin slide guard of claim 1 wherein the coin slide mounting flange is further of the type having depending, transversely spaced supports and wherein the opening in the face is configured to provide transversely spaced, depending legs, the spaced legs of the guard being of suitable dimensions and configuration to receive the spaced supports of the coin slide mounting flange therein.

4. The coin slide guard of claim 1 wherein the face of the guard covers at least some of the mounting flange mounting openings.

5. The coin slide guard of claim 2 wherein the securing openings through the guard face are non-round.

6. The coin slide guard of claim 5 wherein a portion of the fastener shank is non-round and of configuration to cooperate within the non-round guard face securing openings.

* * * * *